US006173853B1

(12) United States Patent
Luch

(10) Patent No.: US 6,173,853 B1
(45) Date of Patent: Jan. 16, 2001

(54) SNAP-ON, SCREW-OFF CAP AND CONTAINER NECK

(75) Inventor: Daniel Luch, Morgan Hill, CA (US)

(73) Assignee: Portola Packaging, Inc., San Jose, CA (US)

( * ) Notice: Under 35 U.S.C. 154(b), the term of this patent shall be extended for 0 days.

This patent is subject to a terminal disclaimer.

(21) Appl. No.: 09/356,063

(22) Filed: Jul. 19, 1999

Related U.S. Application Data

(63) Continuation of application No. 09/071,625, filed on May 1, 1998, now Pat. No. 5,975,321, which is a continuation-in-part of application No. 08/781,453, filed on Jan. 10, 1997, now Pat. No. 5,755,348, which is a continuation of application No. 08/456,741, filed on Jun. 1, 1995, now abandoned, which is a division of application No. 08/029,177, filed on Mar. 10, 1993, now Pat. No. 5,456,376, which is a continuation-in-part of application No. 07/830,133, filed on Jan. 31, 1992, now Pat. No. 5,267,661, which is a continuation-in-part of application No. 07/772,945, filed on Oct. 8, 1991, now Pat. No. 5,213,224, which is a continuation-in-part of application No. 07/565,638, filed on Aug. 9, 1990, now Pat. No. 5,190,178.

(51) Int. Cl.[7] ..... B65D 51/00

(52) U.S. Cl. ..... 215/256; 215/318; 215/320; 215/354

(58) Field of Search ..... 215/252, 254, 215/256, 318, 253, 329, 330, 354, 356, 357, 341, 307, 320; 220/366, 361, 203.01, 203.13

(56) References Cited

U.S. PATENT DOCUMENTS

| | | | | |
|---|---|---|---|---|
| 1,630,687 | * | 5/1927 | Aulbach | 220/296 X |
| 2,181,340 | * | 11/1939 | Plumb | 220/296 |
| 3,022,917 | * | 2/1962 | Montgomery | 215/330 |
| 3,223,269 | * | 12/1965 | Williams | 215/318 |
| 3,695,475 | * | 10/1972 | Ruekberg | 215/43 X |
| 3,837,518 | * | 9/1974 | Gach | 215/256 X |
| 3,844,443 | * | 10/1974 | Cudzik | 215/337 |
| 3,874,540 | * | 4/1975 | Hidding | 215/252 |
| 3,902,621 | * | 9/1975 | Hidding | 215/252 |
| 3,980,195 | * | 9/1976 | Fillmore | 215/256 |
| 4,078,700 | * | 3/1978 | Hidding | 222/109 |
| 4,241,841 | * | 12/1980 | Boller | 215/252 |
| 4,298,129 | * | 11/1981 | Stull | 215/254 |
| 4,354,609 | * | 10/1982 | Hidding | 215/252 |
| 4,385,708 | * | 5/1983 | Curry | 215/256 |
| 4,402,415 | * | 9/1983 | Hopley | 215/256 X |
| 4,448,319 | * | 5/1984 | Kern | 215/329 |
| 4,530,437 | * | 7/1985 | Gray et al. | 215/252 |
| 4,540,102 | * | 9/1985 | Wiedmer | 215/344 |
| 4,548,329 | * | 10/1985 | Curry | 215/216 |
| 4,561,553 | * | 12/1985 | Crisci | 215/256 |
| 4,625,875 | * | 12/1986 | Carr et al. | 215/232 |
| 4,700,860 | * | 10/1987 | Li | 215/256 |
| 4,744,478 | * | 5/1988 | Hahn | 215/252 |
| 4,844,250 | * | 7/1989 | Holoubek et al. | 215/318 X |
| 4,946,055 | * | 8/1990 | Towns et al. | 215/254 |
| 4,981,230 | * | 1/1991 | Marshall et al. | 215/252 |
| 4,989,740 | * | 2/1991 | Vercillo | 215/252 |

* cited by examiner

*Primary Examiner*—Stephen K. Cronin
(74) *Attorney, Agent, or Firm*—Flehr Hohbach Test Albritton & Herbert LLP

(57) ABSTRACT

A tamper-evident, snap-on, screw-off closure is used with a specially shaped container neck. The neck has double lead external threads and, below the threads, a conical wall having external ratchet teeth. The closure has an upper skirt having internal threads mating with the neck threads. A conical lower skirt is connected to the upper skirt by a plurality of frangible bridges. The lower skirt has internal ratchet teeth to mate with the neck ratchet teeth. The cap skirt threads are double pitch and slightly over 360° in length. When the cap is applied to the neck it snaps on in two stages. The lower skirt has a tear tab which, when pulled, fractures the lower skirt on a vertical line. Continued pulling on the tab sequentially fractures the bridges.

13 Claims, 5 Drawing Sheets

SNAP-ON, SCREW-OFF CAP AND CONTAINER NECK

CROSS-REFERENCE TO RELATED APPLICATION

This application is a continuation of U.S. application Ser. No. 09/071,625, filed May 1, 1998, now U.S. Pat. No. 5,975,321, which is a continuation-in-part of U.S. application Ser. No. 08/781,453, filed Jan. 10, 1997, now U.S. Pat. No. 5,755,348, which is a continuation of U.S. Ser. No. 08/456,741, filed Jun. 1, 1995, now abandoned, which is a divisional of 08/029,177, filed Mar. 10, 1993, now U.S. Pat. No. 5,456,376, which is a continuation-in-part of U.S. Ser. No. 07/830,133, filed Jan. 31, 1992, now U.S. Pat. No. 5,267,661, which is a continuation-in-part of U.S. Ser. No. 07/772,945, filed Oct. 8, 1991, now U.S. Pat. No. 5,213,224, which is a continuation-in-part of U.S. Ser. No. 07/565,638, filed Aug. 9, 1990, now U.S. Pat. No. 5,190,178. The disclosures of the above-mentioned application are hereby incorporated herein by reference.

BACKGROUND OF THE INVENTION

1. Field of the Invention

This invention relates to a new and improved container closure and container neck structure and more particularly to a structure wherein the closure is applied with a single one-dimensional axial downward force onto the neck and is held in such position by a tamper-evident band. The consumer destroys a frangible connection between the cap and the band during initial removal, preferably by tearing away the band enabling the closure to be unscrewed from the container neck. When the cap is used for reclosure purposes, it may be screwed on and screwed off in the same manner as screw caps have heretofore been used.

2. Description of Related Art

Prior snap-on, screw-off structures may be classified under either of the following categories:

(1) Those with thread engagement as initially applied, (2) Those without.

The major advantages of the no-thread initial engagement systems are that they are conceptually simple, careful alignment of the closure and the container is not necessary upon application of the closure, and easy (low force) application is possible since no thread-jumping is required. This version can be an aesthetically pleasing, straight wall of threads. On the other hand, the disadvantages of such a system are that it may be confusing to the consumer because initial removal is merely by lifting the cap off the neck but subsequent use requires twisting the cap relative to the neck. Further, it is difficult to use the system with a lined closure because of the height relationships between the finish and the cap, and finally the cap must be relatively tall, which forces the use of fine threads, which can be difficult to mold. None of these disadvantages are present in this invention.

A closure such as Cresci U.S. Pat. No. 4,561,553 has a number of problems. The tamper evident feature of the closure may be circumvented by being able to engage the threads of the neck and closure (thereby creating a mechanical advantage) and back off the cap while the tamper-evident band is intact. Secondly, the device is confusing to the consumer since the cap is screwed off during removal only by inwardly distorting the cap skirt. The cap is reapplied as a standard snap cap. thread engagement as the cap is initially applied has a number of conceptual advantages. Consumer confusion is eliminated since initial removal is by unscrewing. A number of seal systems, including foil, full liner, plugs or other linerless seals can be used. However, full engagement systems heretofore have been difficult to achieve in practice. A disadvantage of a closure such as Carr U.S. Pat. No. 4,625,875 is that there is no practical, consistent means to orient the cap relative to the container so that, after application, the cap must be turned at least slightly to ensure a tight seal. This defeats the purpose of a push-on cap. Also, the use of a stretch snap-band tamper evident ring excessively increases the application force necessary to seat the cap.

The present invention provides full thread engagement by reason of unique thread design and, more particularly, a unique tamper-evident band (i.e., lower skirt portion) attached to the upper part of the cap by multiple bridges or by means of a continuous line of weakness between the cap and tear band, as well as a means of orienting closure and bottle threads to achieve registration prior to straight axial application.

The present invention has considerable advantages over prior structures for the reasons above noted, among others.

SUMMARY OF THE INVENTION

The present invention comprises an improved closure or cap and an improved neck finish. The cap skirt and neck are provided with mating threads of such shape that the cap may be applied in a simple downward vertical movement, the cap skirt and neck flexing sufficiently to permit the threads to slip past each other.

The threads may be continuous or interrupted. Also, instead of there being two threads—one on the neck and one on the cap, one external thread may be replaced with a groove. The term "helical engagement means" is sometimes used herein to encompass all such screw retention means.

The cap has a tamper-evident tear band below the skirt which is connected to the skirt by a plurality of bridges or by a continuous line of weakness. Ratchet teeth are positioned on the inside of the tamper evident band. Correspondingly, the container neck below the threads is formed with external ratchet teeth. The mating ratchet teeth of the cap and container neck are engaged by the initial downward movement of the cap relative to the neck. In other words, in order to engage the ratchet teeth it is not necessary to rotate the cap relative to the neck, thereby differing from conventional threaded tamper-evident caps. It is merely necessary to provide alignment means on the cap and on the container so that the cap is initially properly oriented in such position that a direct single vertically downward movement of the cap relative to the neck causes the threads to slip relative to each other and the ratchet teeth to lock in final position. Chamfers on the ratchet structure of either closure or container can be used as a "fine" orientation system as the closure is initially applied.

To achieve proper registration of threads when a simple direct axial application force is used, both the neck threads and closure threads must be oriented. Orientation of the container is relatively easy. Generally, containers are either non-circular or have non-circular features which may be used for proper orientation. In accordance with a preferred form of the invention shown herein, the closure has a downward projecting tab similar to the tear tab used on push-on tear-off closures. The vertical tear tab characteristic of the present closure is an excellent orientation feature. However, other means for orienting the cap and container may be used.

Thread design is another feature of the invention. A large number of threads per inch of axial height is desirable for two reasons. First, a fine thread may be used and such a thread does not have to be as deep as a coarse thread, and hence the forces required for threads to jump during application are minimized. Secondly, fine threads minimize the height required to achieve a standard design criterion of 360° or more of thread engagement which permits a lighter closure weight.

The greater the number of thread leads, the less actual turning action is required to remove or reapply the cap. In addition, multiple thread leads promote more "squareness" during straight axial application. In other words, the cap seats horizontally on the neck because the termini of the threads are statically balanced. However, additional leads require a higher thread pitch assuming constant threads per inch and excessively high thread pitch results in a situation where the closure may back off or unscrew itself from sealed position.

In accordance with the present invention, a preferred thread for a blow-molded, high density polyethylene bottle is 12 threads per inch and two leads. If bottle finish processing permits, it would be advantageous to design for higher threads per inch and more leads. For example, if the bottle is made with injection blow mold equipment, a very fine bottle thread is possible. In that case, it might be preferable to use, for example, a 16 thread-per-inch, 4 lead, 4 pitch thread. The more leads, the more squarely the cap sets on the neck and the more effectively the closure will be seated by a direct downward, axial application force. Also, consumer advantages of quick release and reapplication can be achieved with multiple lead threads.

In order to provide a tamper-evident feature, the closure should not be removable without some apparent closure characteristic changing. Generally, this requirement is satisfied by incorporating a frangible section which is destroyed during initial closure removal. One type of frangible section is a continuous thinned tear line, but in a cap of the present invention, such a system may not be the best choice, although permissible and is disclosed as a modification of the first embodiment of the invention. A preferred tamper-evident feature provides a frangible section having a number of frangible connections or bridges between the closure skirt and a tamper-evident ring below the bottom edge of the skirt. The preferred approach is to incorporate enough bridges around the circumference such that the combined strength of the bridges prevents unscrewing. The tamper evident band must be removed to allow unscrewing Sequential breaking of the many bridges around the circumference simulates a continuous tear. A second approach is to incorporate only a few bridges around the circumference of the skirt such that the combined strength of the bridges is not sufficient to prevent unscrewing and the bridges rupture as the cap is initially unscrewed. With this second approach the broken bridges give evidence of opening. A major advantage of using bridges rather than a continuous tear strip is that a wide range of material choices is possible. Therefore a multiple bridge simulated tear structure is generally preferred over continuous tear frangible sections and this approach is used in the preferred embodiments of the present invention. However, in a modification of the invention an uninterrupted horizontal shoulder between the upper and lower portions of the cap is used, which shoulder is formed with a line of weakness. The alternative modification eliminates the space between the bridges to create a continuous frangible line. This modification is used successfully only when the cap is formed of a low density polyethylene and is not successfully used with higher density plastic materials. One of the advantages of the elimination of the spaced bridges is that of cleanliness in that the continuous shoulder prevents dirt and liquids from contacting any portion of the neck surface above the bottom edge of the cap.

In a preferred embodiment of the invention hereinafter described in detail, the closure is first oriented by means of its tear tab and the containers are likewise oriented. The closure and bottle are snapped together and the orientation allows registration of both the threads and the ratchets which hold the cap in place until the tamper-evident band is removed. Seal of the container may be made with a liner, foil or a linerless feature such as a plug or flap. Before initial removal, the multiple bridges are collectively sufficiently strong to prevent unscrewing and also resist any tendency of the closure to back off the neck. During initial removal, in the preferred embodiment the tear band is removed through sequential breaking of the bridges, thereby simulating a continuous tear strip but allowing the use of such plastic materials as polypropylene and high density polyethylene. Once the tear band is removed, the system functions as with normal threaded closures. Alternatively the upper and lower portions of the cap skirt are connected by a reduced number of angularly spaced bridges. Merely by twisting the upper skirt portion the bridges may be severed, giving evidence of tampering, and making it possible to unscrew the cap.

One of the features of the present invention is that the lower skirt portion, which includes tamper-evident features and, more particularly, contains ratchet teeth mating with corresponding teeth on the container neck, is formed with a vertical line of weakness and a tear tab adjacent thereto. When the lower skirt is removed it tears along the vertical line of weakness as well as along the line of weakness between the upper part of the cap and the lower skirt (i.e., tamper-evident band.) This feature has a number of advantages:

First, it prevents defeating the tamper-evident feature. Were it not for the vertical line of weakness, a dishonest patron might unscrew the upper cap, remove the contents of the container and replace the cap. It is somewhat difficult to observe that the line of weakness between the upper cap and tamper-evident band has been severed. When the vertical line of weakness is severed, this is not a problem since the lower skirt cannot be replaced.

Second, if the molds for the cap are not perfectly supported, plastic material may fill some or all of the voids between bridges joining the upper cap to the tamper-evident band. This makes it difficult for some users to remove the tamper-evident band. The vertical line of weakness makes it much easier to remove the lower skirt or band. Indeed, the bridges between the upper cap and band may be made thicker or some of the voids between bridges may be eliminated.

Thirdly, the intact tamper-evident band may create a danger to wildlife if the head of a bird, fish or small animal is entrapped therein. Splitting the band along the vertical line of weakness eliminates this hazard.

A further feature of the invention is the fact that the cap ratchet lug on the interior of the lower cap skirt is located between two external lugs on the neck finish when the cap is applied so that on application the cap cannot rotate outside of its "tolerance range"—that is, there is an orientation feature of the cap and bottle ratchets for proper engagement.

Another advantage of the invention is that the cap may be applied to the neck in two stages (i.e., "double click"). When the container is filled with. milk or certain other liquids, entrapped air or other gases tend to cause foam. The thread structure of the present invention makes it possible to press the cap down until one set of threads passes the other. This holds the cap on the neck and holds it properly aligned relative to the neck ratchet. However, the cap is not tight and hence air and gas may escape. Then the cap is pressed down once more to tightly engaged and sealed position. To insure two "clicks" the closure thread has to jump two neck threads during application. This means that if the cap threads extend a full 360° around the cap skirt inner wall (180° each for double lead threads), the finish threads have to be repetitive at some point of the circumference. This also means that either the cap threads or the finish thread must be repetitive vertically. I.e., the threads must overlap on either the neck or cap in order to make possible the double click.

More specifically, the caps pass down a conveyor overlying the path of the containers and as each container passes the end of the conveyor, a cap drops onto the neck. The cap and neck then pass under a roller which preliminarily presses the cap down on the neck. One of the features of the thread construction of the present invention is that there is more than one full turn of thread engagement of the threads. Hence, the roller pushing the cap through the first step or snap prevents the latter from falling off the neck when it is subjected to such action as milk foaming in the interior of the container. Hence the cap stays on the bottle, although not being tightly sealed thereto, until the bottle passes under the conventional capping machine belt or pressure plate which fully seats the cap on the neck. This is a second step or snap of the cap on the bottle and insures that both threads are tightly engaged.

When the first snap of the cap on the bottle occurs, the ratchet teeth of the cap engage the ratchet teeth of the neck but a slight twisting is possible within the range of tolerance of approximately 20 degrees. Such a rotation of the cap relative to the neck changes the height of the cap only about 0.009 inches. However, this turning ability of the cap relative to the neck with such slight changes in the height of the cap relative to the neck insures proper final alignment of the ratchet teeth of the cap and neck, while permitting release of foam or excess air.

Still another feature of the invention is an internal shoulder at the intersection of the underside of the disk and the top of the upper cap skirt. This shoulder prevents the cap from being turned or torqued to jump threads or strip the threads. The inner plug of the cap tends to push the neck of the bottle outward against the shoulder and the shoulder then prevents turning or stripping. Further, the fit of the shoulder against the neck tends to reduce leakage and rigidities the cap.

Another feature of the present invention is that the cap is provided with a plug or inner skirt which fits inside the bottle neck. The length of this plug is related to the positioning of the screw threads on the cap in such manner that the threads of the cap and bottle neck engage before the plug engages the neck. Thus a quarter-turn of each of the double lead threads occurs before the plug contacts the neck. This feature reduces the possibility of cross-threading when the cap is applied to the neck as a reclosure cap.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 7:
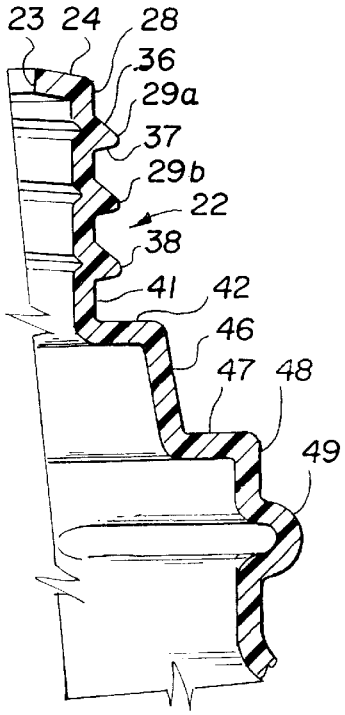
FIGS. 7 and 8 are, respectively, enlarged fragmentary sectional views taken along lines 7—7 and 8—8 of FIG. 6.
Figure 8:
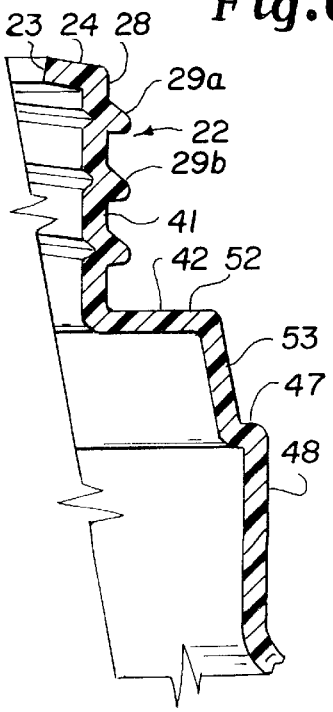

Cap 21, hereinafter described in detail, is used with a container neck 22. Neck 22 has a central neck opening 23 and extending outwardly thereof a downward-outward slanted lip flange 24 which terminates in a vertical stretch 28. The exterior of neck 22 is hereinafter described. The interior thereof forms no part of the present invention. With a blow-molded bottle finish as illustrated in FIGS. 7 and 8, the interior contour of the neck generally tends to follow that of the exterior. However, it will be understood that other types of bottles may be used and in such instances the internal neck shape may vary from that of the exterior.

Extending outward of stretch 28 are threads 29. In the depicted embodiment of FIGS. 7 and 8 there are two threads 29 designated 29*a* and 29*a*. In the embodiment, the finish has twelve threads per inch with a double lead, each thread being six pitch and extending slightly in excess of 360° of a full thread. Thus the upper terminus 31 of the first thread is vertically displaced approximately 0.166 inch from the lower terminus thereof. The upper terminus 33 of the second thread is displaced 180° relative to terminus 31 and its lower terminus 34 is approximately diametrically opposite terminus 32. It is understood that the threads can be extended greater than 360° to achieve increased thread engagement. Also, additional thread leads and different linear thread density (threads per inch) are permitted and may be advantageously chosen. In order to permit the threads of the cap to slip past the threads of the neck, as shown in FIG. 7, the upper flank 36 of thread 29 slants downwardly/outwardly at approximately 45° while the lower flank 37 slants downwardly/inwardly at an angle of about 10°. Preferably the thread apex 38 is made with as large a radius as possible. A portion 41 of vertical stretch 28 is located below the threads 29 extending down to upper shoulder 42, which is horizontal.

As stated previously, instead of threads on the inside of the skirt and outside of the neck, one thread may be replaced by a groove. Further, instead of threads 29 being continuous, they may be interrupted.

Below shoulder 42 is locking area wall 46 which slants downward/outward at an angle of about 10°. Wall 46 terminates in lower shoulder 47 which is also approximately horizontal. Outwardly of and below shoulder 47 is a lower vertical stretch 48 which at its lower end merges with the container. Bumper ring segments 49 (here shown as four in number) may be formed in the stretch 48 to facilitate gripping the container during filling and loading and also to provide certain vertical flexibility to the neck during the capping operation.

Figure 6:
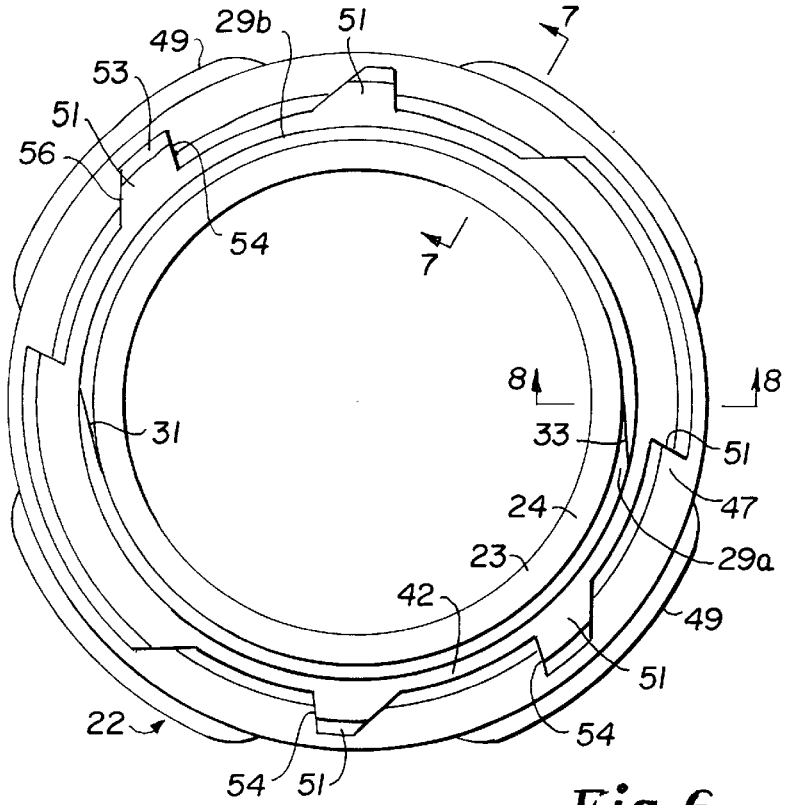
FIG. 6 is a top plan of the neck.

On opposite sides of neck 22 projecting out from wall 46 are teeth 51. As illustrated in FIG. 6, there are typically thee such teeth on one side of the container neck and three teeth on the opposite side. The total extent of the three teeth on each side is approximately 90°. Each tooth has a top surface 52 which can be co-planar with the surface of shoulder 42. Outer surface 53 slants downward/outward at an angle of approximately 10°, terminating in shoulder 47. The front edges 54 viewed from above in plan as in FIG. 6 (assuming a right-hand thread) are disposed at varying angles from about 45° to about 0° relative to a radial line drawn perpendicular to the vertical axis and are approximately vertical.

A preferred cap 21 used with the neck structure 22 previously described is illustrated in FIGS. 1 to 5. The cap has a generally flat top disk 61 from the periphery of which depends substantially vertical short upper skirt 62. The lower edge of skirt 62 merges with slanted stretch 63, which, in turn, merges with vertical stretch 64. An internal shoulder 65 is formed at the intersection of stretches 62 and 63. Members 62, 63, 64 have vertical ribs 66 spaced therearound to enable the user to grip the cap. Chamfers 67 are preferably formed on the upper edges of ribs 66. The ribs of the cap are thus, in effect, rounded but extend higher. Hence they are more severely gripped by the user when screwing or unscrewing the cap.

On the interior of skirt 66 are formed threads 71*a* and 71*b* which are selected to mate with threads 29*a* and 29*a* of neck 22. The bottom edge 72 of skirt 64 is connected to shoulder 73 and generally downwardly/outwardly slanted lower skirt 74 by a plurality of bridges 76 which in fact constitute the lower edges of ribs 66. The bridges and voids therebetween are sometimes referred to herein as "horizontal lines of weakness". Skirt 74 has a generally horizontal lower edge 77.

Teeth 81 spaced and dimensioned to match the teeth 51 of neck 22 are formed on the inside of wall 74. The inner edges 82 of the teeth are positioned close to inner surface 46 after cap application. The leading edge 83 of each tooth 81 is formed at an angle of approximately 45° to a radial line, thereby ensuring good interlock with the complementary surface 54 of neck 22. This angular relationship biases the cap 21 into a more secure locking arrangement with the neck 22.

Tear tab 86 extends downwardly from lower edge 77 and an upper side edge thereof merges with a weakened vertically extending line 87 formed in skirt 74. Use of weakened line 87 is optional, but preferably used to prevent the ring-like skirt 74 being a hazard to wildlife and to accomplish the other objects set forth earlier in this description. When the consumer grips tab 86, bridges 76 are severed and the vertical weakened line 87 is broken. Thus pulling the tab 86 sequentially fractures weakened line 87 and then each of the bridges 76 (i.e., the horizontal weakened line). Removal of the lower skirt 74 removes the ratchet teeth 81 and hence frees the upper portion of the cap so that it can be unscrewed. However, such removal of the lower skirt gives evidence of the opening of the cap and hence is a tamper-evident feature. Alternatively, the user may twist upper skirt 64, severing bridges 76. To prevent defeating the tamper-evident features of the cap, the bridges may be made stronger. A combination of circumferentially spaced thin bridges 76 and arcuate continuous areas relieved by circular arc tear lines may be used.

Although various liners may be used to secure the under side of disk 61 to the lip flange 24 of neck 22, in the accompanying drawings, a preferred embodiment shows an inner skirt or plug 91 extending downward from top disk 61 and fitting inside the neck opening 23. Preferably the outer bottom edge of skirt 91 is formed with a bevel 92 to facilitate seating of the cap 21 on the neck 22. A circular rib 94 on the underside of disk 61 is located between plug 91 and skirt 62 and engages neck lip flange 24 to provide a secondary seal.

The threads 71*a*, 71*b* of cap 21 are double lead and each extends around the circumference of the cap in excess of 180°—i.e., approximately 200°. The threads 71*a*, 71*b* originate very close to the bottom edge 72 of vertical stretch 64. Threads 29*a* and 29*a* of the neck 22 originate spaced somewhat downwardly from the top on vertical stretch 28. As has previously been stated in the summary of this invention, in conventional capping machines, cap 21 is deposited on neck 22. Because of the fact that the threads 71*b* and 71*a* are diametrically opposed, the cap 21 tends to rest on the neck 22 approximately horizontally. The first step in seating cap 21 is to pass under a roller which pushes the cap 21 downwardly. The threads on the cap slip over the uppermost threads on the neck 22 during this first step which may be termed a "first snap". At this point the cap is not fully seated, still resting at least one bottle thread above its fully seated and applied position. If the container has been filled with a substance such as milk which tends to foam, the first snap action permits some of the air in the container to escape since the cap is not completely sealed on the neck. Thereafter, the cap and container pass under a seating belt or pressure plate which forces the cap 21 downward until it is completely seated on the neck 22, thereby completing the second snap or step. To achieve this advantageous "double snap application" the relative axial movement of cap and bottle neck to a fully sealed and seated position must involve a portion of the cap threads jumping at least two neck threads or vice versa.

The first step in the seating of the cap on the neck (first snap) brings the teeth 81 of the cap into partial engagement with the teeth 51 of the neck, but within about a 20° tolerance. This permits the aforementioned foaming without allowing cap rotation away from proper orientation. The second step of the seating causes the teeth 81 and 51 to fully interengage.

Figure 9:
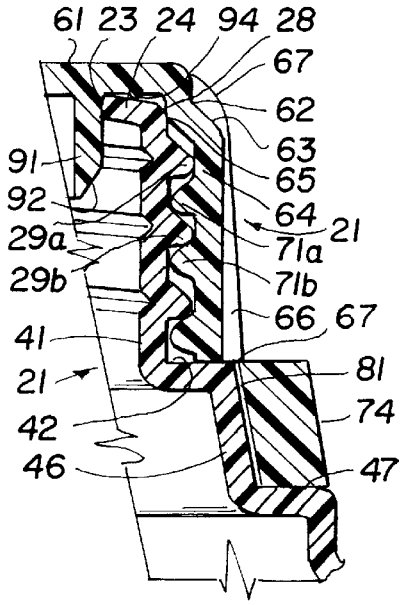
FIG. 9 is an enlarged, fragmentary sectional view through an assembled cap and neck taken in the positions of line 4—4 of FIG. 2 and 7—7 of FIG. 6.

Another feature of the invention best shown in FIG. 9 is the function of the shoulder 65 of cap 21. The inner plug 91 tends to push the lip 24 outwardly. Hence the shoulder 65 tightly engages the surface 28 and promotes effective sealing.

Figure 10:
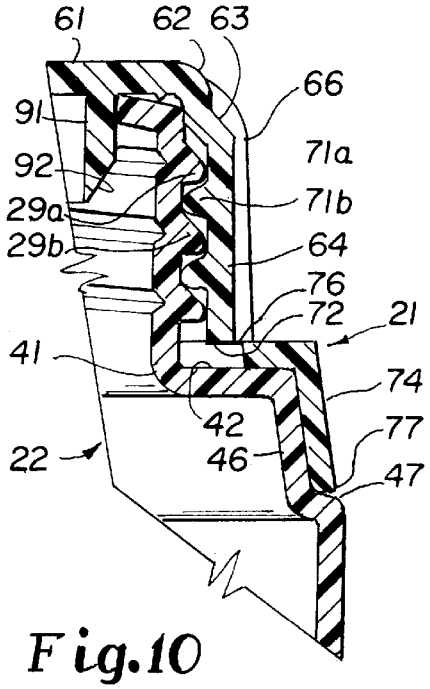
FIG. 10 is a view similar to FIG. 9 taken in the positions of line 5—5 of FIG. 2 and 8—8 of FIG. 6.
Figure 10A:
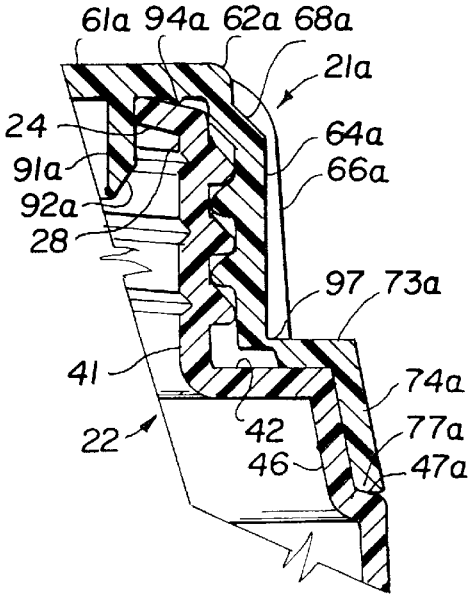
FIG. 10A is a view similar to FIG. 10 of a modification.

Directing attention now to FIG. 10A, instead of bridges 76 being formed connecting the shoulder 73*a* to the lower end of vertical stretch 64*a*,the shoulder 73*a* is continued inward but the material is very thin. In other words, a horizontal line of weakness 97 replaces the bridges 76 but the line of weakness is continuous. Hence the lower skirt 74*a* may be removed by tearing away the line of weakness 97.

The use of the modification of FIG. 10A is particularly suited when the cap is made of a material such as low density polyethylene. An advantage of having a line of weakness rather than separated bridges is that dirt and water cannot enter in the voids between the bridges and collect between the cap and neck.

In other respects the modification of FIG. 10A resembles that of the preceding modification and the same reference numeral followed by the subscript a is used to designate corresponding elements.

PREFERRED OPERATION

After the container has been filled, it is transported through a capping machine. As is well understood in the bottling art, and in a manner similar to that whereby push-on, pull-off caps are applied, the caps 21 are fed one at a time out of a bowl in the capping machine along a conveyor, the tear tabs 86 orienting the caps so that they are all discharged in a pre-determined orientation relative to the containers which pass therebelow. Although not shown in the accompanying drawings, each container has a square cross-section or some other variation from a round shape which permits the container neck 22 to be oriented relative to the cap 21. The structure of capping machines is well known in the bottling art. Because of the relative orientation of the cap 21 and container neck 22, the teeth 81 of the cap are in vertical alignment with the gaps between teeth 51 of neck 22. An axially downward force is applied to cap 21 causing it to move down. As it moves down, the inner skirt 91 fits inside neck opening 23. T he threads 71*a* and 71*c* slip over threads 29*a* and 29*b*, the slanted surfaces 36 facilitating such movement. As has been stated, the sealing is preferably in two steps or snap actions. The cap 21 is sufficiently resilient so that it expands outward sufficiently to permit the threads to slip. As the cap 21 seats on the neck 22, the teeth 81 engage between the teeth 51 to fully seat the teeth 81 in place. Flange 24 then engages the under side of disk 61 and the outer wall of inner skirt 91, sealing the container. The engagement of threads 71 and 29 retain the cap tightly to the neck.

Figure 11A:
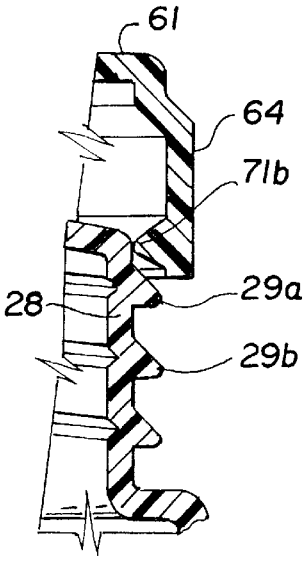
FIGS. 11A, 11B and 11C are schematic views showing progressive "double click" cap attachment wherein the cap thread has one turn and the neck has multiple threads.
Figure 11B:
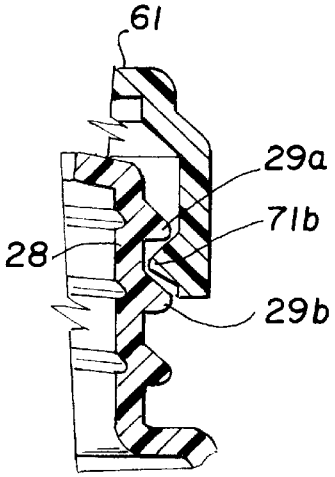
Figure 11C:
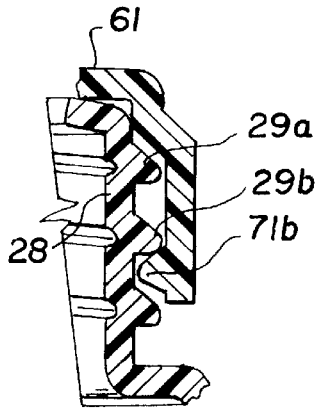

FIGS. 11A, 11B and 11C illustrate schematically the two-step seating heretofore described. In FIG. 11A the single turn cap thread 71*b* rests on the top of the uppermost neck thread. In FIG. 11B the thread 71*b* of the cap has been pushed over neck thread 29*a* but the cap is not fully seated. Hence gases may escape from the container. In FIG. 11C the second click occurs, when thread 71*b* seats under thread 29*b*.

Figure 12A:
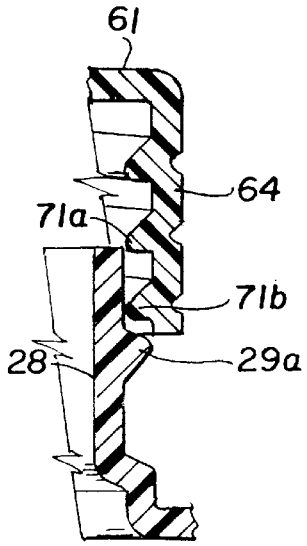
FIGS. 12A, 12B and 12C are views similar to FIGS. 11A, 11B and 11C wherein the neck thread has one turn and the cap thread multiple turns.
Figure 12B:
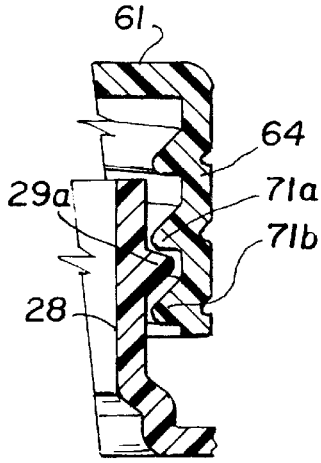
Figure 12C:
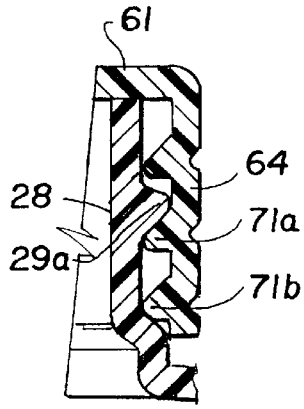

FIG. 12A shows a reverse situation wherein thread 29*a* on the neck rests under the cap thread 71*b*. In FIG. 12B the first click has occurred and thread 29*a* is between threads 71*a* and 71*b*. FIG. 12C shows completion of seating wherein thread 29*a* is above threads 71*a* and 71*b*.

After the cap 21 has been fully seated on neck 22 it cannot be removed without giving evidence of tampering. Thus the interengagement of teeth 81 and 51 prevent unscrewing the cap and the interengagement of threads 71 with threads 29 prevents lifting the cap off the neck.

When it is desired to open the container, the user grips the tab 86 and breaks line 87, then pulls circumferentially around the container causing the lower skirt 74 to be removed, thereby removing the teeth 81. This gives evidence of tampering. However, it also permits the user to grip the ribs 66 and unscrew the cap 21 from neck 22.

Figure 1:
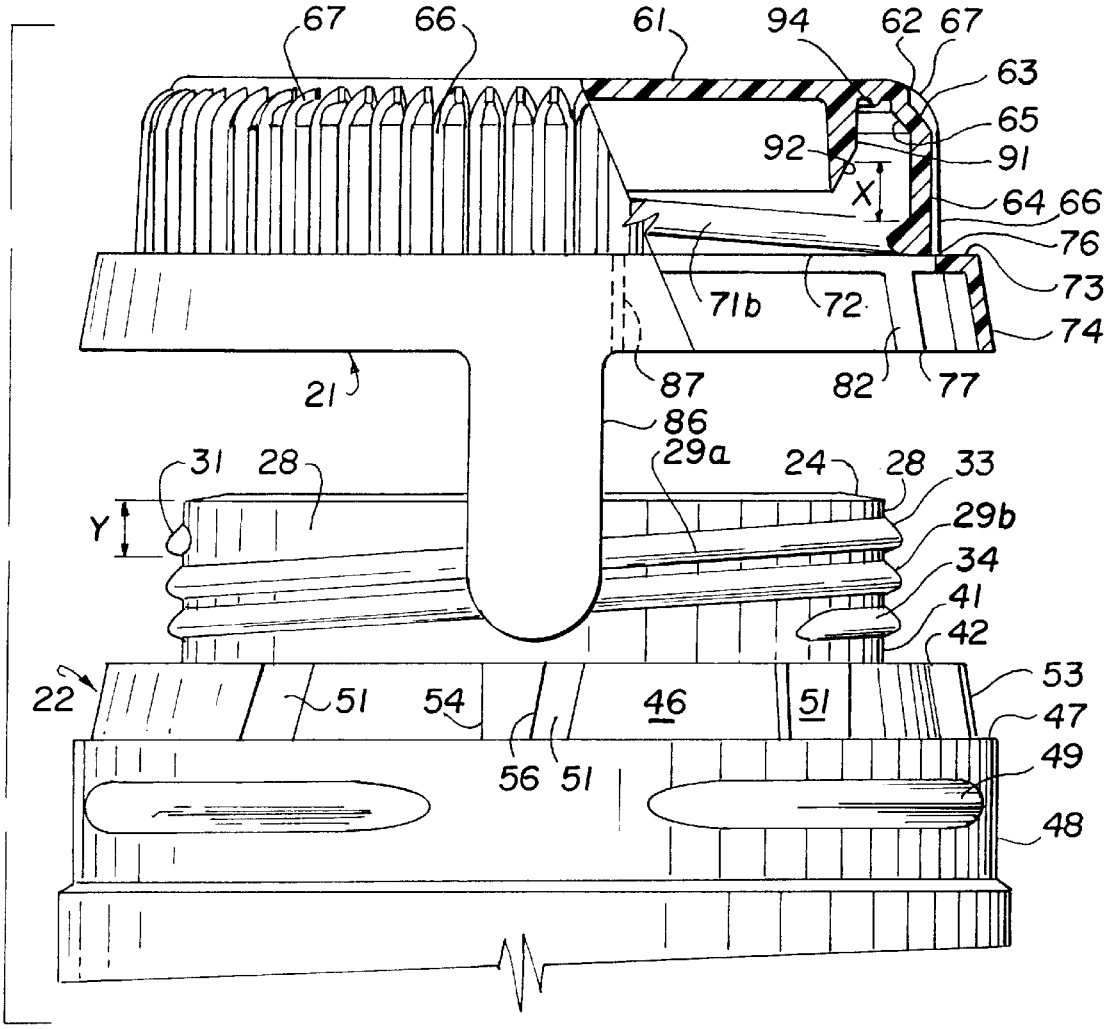
FIG. 1 is a side elevational view of a cap and neck before assembly, the cap being partially broken away in section to reveal internal construction.
Figure 2:
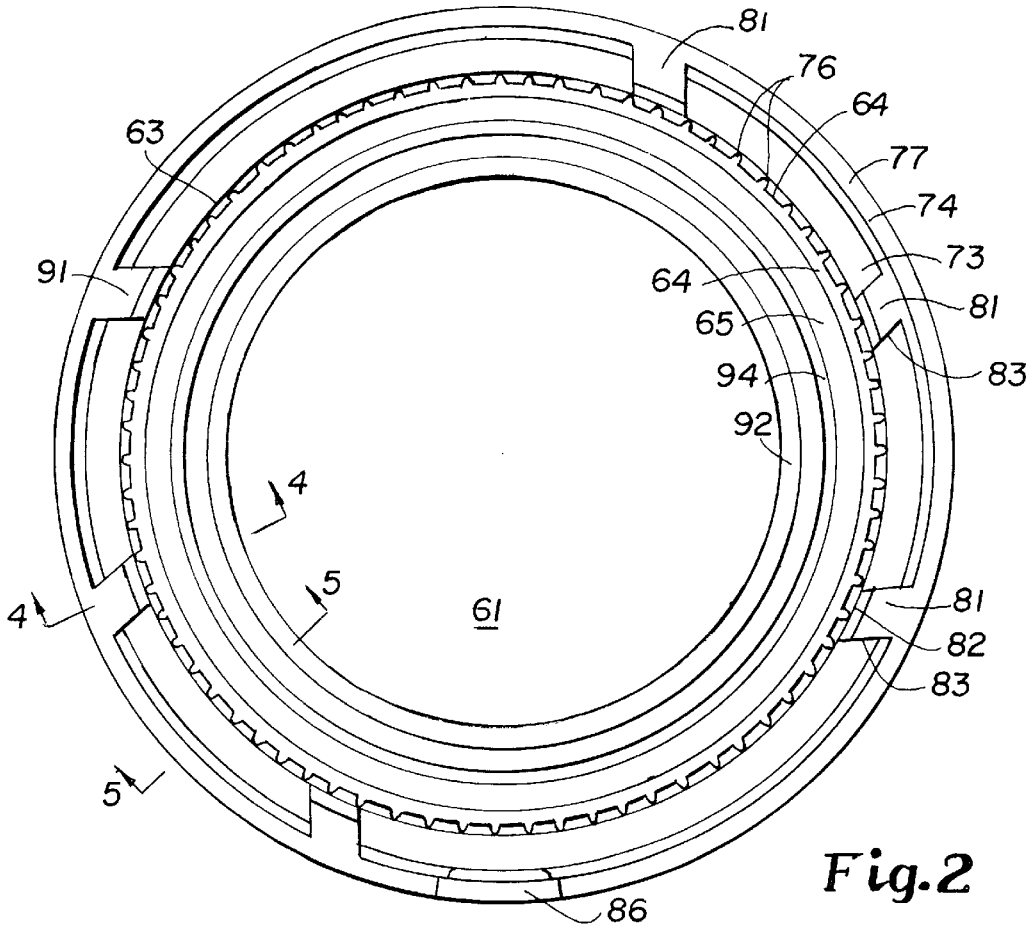
FIG. 2 is a bottom plan of the cap.
Figure 3:
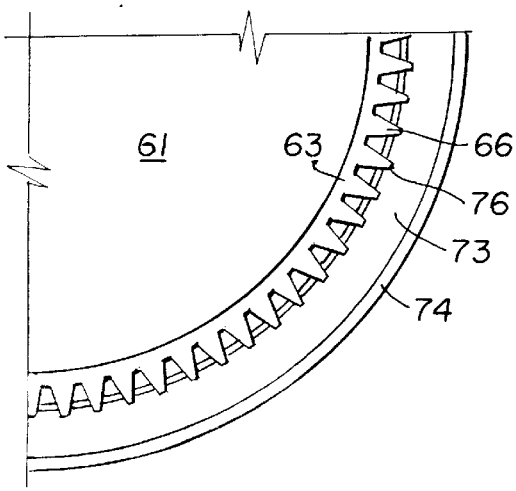
FIG. 3 is a fragmentary enlarged top plan of the cap.
Figure 4:
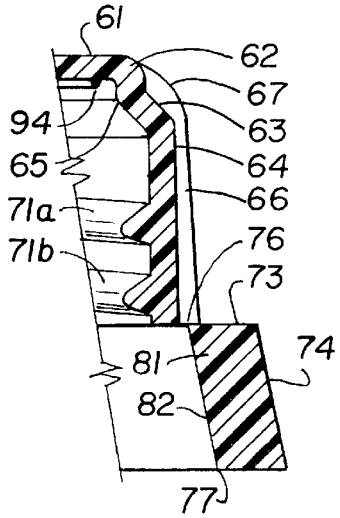
FIGS. 4 and 5 are, receptively, enlarged, fragmentary sectional views taken along lines 4—4 and 5—5 of FIG. 2.
Figure 5:
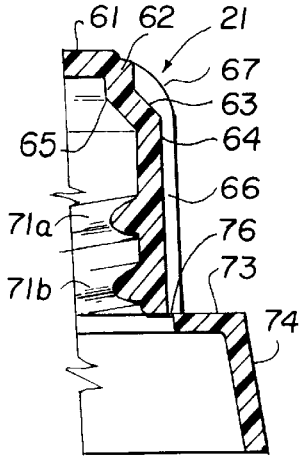

To replace the cap, it is merely necessary to reverse the direction of turning. Directing attention now to the structure shown in FIG. 1, another feature of the relationship between the plug 91 and threads 71*a*, 71*b* is shown. It is desirable that when the portion of the cap 21 above the lower skirt 74 is used as a reclosure cap, that proper seating of the reclosure cap be insured so that the reclosed bottle does not leak. In FIG. 1 the reference letter x is used to designate the vertical distance between the upper edge of threads 71*a* and 71*b* and the point at which the flange 24 of neck 22 contacts the slanted surface 92 of plug 91. The reference letter y is used to designate the minimum vertical dimension between the top edge of vertical stretch 28 of neck 22 and the underside of the thread start 31. A feature of the structure is that at some position of the cap the dimension x be greater than the dimension y. Hence when the reclosure cap is placed on the container neck, the threads interengage, preferably a quarter-turn or more before the upper edge of the container neck engages the inner skirt or plug. This prevents cross-threading or stripping of the threads when the reclosure cap is tightened on the neck.

As used in the claims, the term "thread" is used not only to include external threads but internal ones as well and to include continuous and interrupted threads or other "helical engagement means". In the specification and claims, the cumulative turn total for multi-lead threads or other such helical engagement means is the sum total of the number of turns of the individual multi-lead threads around either the neck stretch portion or the upper skirt portion. For multi-lead threads, "in excess of one turn total" means that the sum total of the number of turns of the individual threads is in excess of 360°. The language "at least one vertically extending arc stretch" refers to a portion of the upper skirt or neck stretch where the threads overlap or are repetitive vertically, whereby a vertical line drawn within the arc stretch will intersect at least two threads. When the threads on either the cap or the neck overlap (i.e. a vertical line drawn within the arc stretch will traverse the helical engagement means at least two times), the application of the cap onto the container with at least two "clicks" is ensured.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. In combination, a container neck and a container closure, said neck having an upper opening, a lip flange at said opening, said lip flange having a top, a downward extending neck stretch portion below said opening, said neck stretch portion having an exterior, at least one first helical engagement means around said exterior of said neck stretch portion, said at least one first helical engagement means having a lower surface, a locking wall portion below said neck stretch portion, at least one first tooth on said locking wall portion, said closure having a top, said top having an underside, a hollow plug disposed centrally of said underside of said top dimensioned to fit inside said lip flange, a downward extending upper skirt portion depending from said top, said upper skirt portion having an interior, at least one second helical engagement means around said interior of said upper skirt portion shaped to mate with said at least one first helical engagement means, said at least one second helical engagement means having an upper surface, a lower skirt portion below said upper skirt portion, frangible means joining said upper and lower skirt portions together, at least one second tooth on said lower skirt portion shaped to engage said at least one first tooth to prevent unscrewing of said closure relative to said neck without breaking said frangible means, said at least one first and second helical engagement means being shaped to slip over each other upon direct axial downward movement of said closure on said neck without relative rotation of said closure and said neck and then to interengage, said plug having a contact point located on said plug where said plug first engages said lip flange when said closure is applied to said neck, said contact point and said upper surface of said at least one second helical engagement means being separated by a maximum vertical distance, said top of said lip flange and said lower surface of said at least one first helical engagement means being separated by a minimum vertical distance, said maximum vertical distance between said contact point and said upper surface of said at least one second helical engagement means is greater than said minimum vertical distance between said top of said lip flange and said lower surface of said at least one first helical engagement means, thereby ensuring engagement of said at least one first and second helical engagement means prior to contact between said plug and said lip flange.

2. The combination of claim 1 which further comprises means to remove said lower skirt portion from said closure, said means to remove said lower skirt portion comprising a tear tab connected to said lower skirt portion.

3. The combination of claim 1 in which said lower skirt portion is formed with a line of weakness extending through said lower skirt portion.

4. The combination of claim 3 in which said line of weakness is a vertical scoreline.

5. The combination of claim 1 in which said frangible means comprises a plurality of spaced bridges.

6. The combination of claim 1 in which said at least one first and second helical engagement means are multilead, whereby said closure tends to rest horizontally on said neck prior to said downward movement.

7. In combination, a container neck and a container closure, said neck having an upper opening, a lip flange at said opening, a downward extending neck stretch portion below said opening, said neck stretch portion having an exterior, at least one first helical engagement means around said exterior of said neck stretch portion, a locking wall portion below said neck stretch portion, at least one first tooth on said locking wall portion, said closure having a top, said top having an underside, a hollow plug disposed centrally of said underside of said top dimensioned to fit inside said lip flange, a downward extending upper skirt portion depending from said top, said upper skirt portion having an interior, at least one second helical engagement means around said interior of said upper skirt portion shaped to make with said at least one first helical engagement means, a lower skirt portion below said upper skirt portion, frangible means joining said upper and lower skirt portions together, at least one second tooth on said lower skirt portion shaped to engage said at least one first tooth to prevent unscrewing of said closure relative to said neck without breaking said frangible means, said at least one first and second helical engagement means being shaped to slip over each other upon direct axial downward movement of said closure on said neck without relative rotation of said closure and said neck and then to interengage, said closure being formed with an internal shoulder at the intersection of said underside of said top and said interior of said upper skirt portion, said should engaging said neck stretch portion.

8. In combination, a container neck and a container closure, said neck having an upper opening, a lip flange at said opening, a downward extending neck stretch portion below said opening, said neck stretch portion having at least one first helical engagement means, a locking wall portion below said neck stretch portion, at least one first tooth on said locking wall portion, said closure having a top, said top having an underside, a hollow plug disposed centrally of said underside of said top dimensioned to fit inside said lip flange, a downward extending upper skirt portion depending from said top, said upper skirt portion having an interior, at least one second helical engagement means shaped to mate with said at least one first helical engagement means, a lower skirt portion below said upper skirt portion, frangible means joining said upper and lower skirt portions together, at least one second tooth on said lower skirt portion shaped to engage said at least one first tooth to prevent unscrewing of said closure relative to said neck without breaking said frangible means, said at least one first and second helical engagement means being shaped to slip over each other upon direct axial downward movement of said closure on said neck without relative rotation of said closure and said neck and then to interengage.

9. The combination of claim 8 which further comprises means to remove said lower skirt portion from said closure, said means to remove said lower skirt portion comprising a tear tab connected to said lower skirt portion.

10. The combination of claim 8 which said lower skirt portion is formed with a line of weakness extending through said lower skirt portion.

11. The combination of claim 10 in which said line of weakness is a vertical scoreline.

12. The combination of claim 8 in which said frangible means comprises a plurality of spaced bridges.

13. The combination of claim 8 in which said at least one first and second helical engagement means are multilead, whereby said closure tends to rest horizontally on said neck prior to said downward movement.

* * * * *